US005525844A

United States Patent [19]

Doolittle, III et al.

[11] Patent Number: 5,525,844

[45] Date of Patent: Jun. 11, 1996

[54] AUTOMATICALLY RETRACTABLE RADIO ANTENNAS FOR AUTOMOTIVE VEHICLES

[75] Inventors: William W. Doolittle, III, Ann Arbor; Robert G. Malcolm, Waterford, both of Mich.

[73] Assignee: Chrysler Corporation, Auburn Hills, Mich.

[21] Appl. No.: 365,441

[22] Filed: Dec. 28, 1994

[51] Int. Cl.[6] ..... H01Q 1/10

[52] U.S. Cl. ..... 307/10.100; 318/466; 343/903

[58] Field of Search ..... 307/9.1, 10.1, 307/141, 141.4, 120; 361/170; 343/901–903, 711, 721; 318/280, 283, 282, 286, 483, 466, 468, 469

[56] References Cited

U.S. PATENT DOCUMENTS

| | | | |
|---|---|---|---|
| 4,023,887 | 5/1977 | Speers | 250/227.28 |
| 4,126,820 | 11/1978 | Hörmann et al. | 318/468 |
| 4,755,791 | 7/1988 | Kuroda | 343/721 |
| 4,803,493 | 2/1989 | Jamison | 343/901 |
| 4,864,322 | 9/1989 | Yamamoto et al. | 343/903 |
| 4,990,836 | 2/1991 | Nakase et al. | 318/466 |
| 5,097,188 | 3/1992 | Nakase et al. | 318/466 |
| 5,235,344 | 8/1993 | Shinkawa et al. | 343/903 |
| 5,442,242 | 8/1995 | Yoshida | 307/10.1 |

*Primary Examiner*—William M. Shoop, Jr.
*Assistant Examiner*—Richard T. Elms
*Attorney, Agent, or Firm*—G. Andrew Barger

[57] ABSTRACT

Automotive vehicles equipped with automatic or standard transmissions and having automatically extending and retracting radio antennas are equipped with an arrangement for automatically retracting the antennas upon shifting from drive to neutral. Many car washes are equipped with endless belts or chains which engage and tow automotive vehicles through car washes. Before being towed, the drivers must shift to neutral. Drivers are also advised to lower radio antennas. By causing automatic lowering of radio antennas upon shifting from drive to neutral, drivers need no longer remember to retract their antennas. In order to have the arrangement operate effectively, there is about a 10 second delay in retracting the antennas upon shifting to neutral and extension immediately upon shifting out of neutral. An over-ride is provided should the driver for one reason or another desire to leave the transmission in neutral for a period of time greater than 10 seconds.

9 Claims, 6 Drawing Sheets

AUTOMATICALLY RETRACTABLE RADIO ANTENNAS FOR AUTOMOTIVE VEHICLES

FIELD OF THE INVENTION

The present invention relates to automatically retractable radio antennas for automotive vehicles. More particularly, the present invention relates to automatically retractable radio antennas for automotive vehicles which retract in response to actions other than turning off the associated radio.

BACKGROUND OF THE INVENTION

Modern automotive vehicles are almost universally equipped with radios which require antennas. While some antennas are embedded in the windshield glass of automobiles, it has been found that external rod antennas generally provide better reception. For many years now, these antennas have had a telescoping configuration so that the antennas could be collapsed when not in use. Manual extension and retraction of antennas has given way to antennas which are extended and retracted by motors activated by switches on the instrument panel of the car. More recently, motors for extending and retracting antennas have been activated by the "on-off" switch of automobile radios so that, when a radio is turned on, the antennas extend and, when it is turned off, the antenna retract.

Automatic car washes are now used by millions of automobile owners. These car washes have flexible rotary brushes which whip against the outer surface of the automobile to dislodge dirt. If the radio antenna is extended, the brushes can snag and damage the antenna. Every year numerous radio antennas are damaged by car wash brushes. The antennas need only be bent enough to form a crimp therein to prevent the antennas from completely retracting. If an antenna does not completely retract, it can be further damaged by subsequent washings. Moreover, projected antennas can be damaged in other ways, such as by passing vandals who have a propensity for breaking off automobile radio antennas.

Once an antenna is bent in a car wash, it is wise for the owner to replace the antenna. This is not an inexpensive proposition. Since the incident usually occurs while the vehicle is under warrantee and the customer frequently disavows any knowledge of forgetting to turn off the radio in order to retract the antenna, the cost may be frequently borne by the automobile manufacturer. Because the antenna may be mounted in a rear fender, many customers do not know that the antenna projects when the radio is turned on and retracts when the radio is turned off. This, of course, can lead to rather subtle confusion in customer relations.

In view of these considerations and other considerations, there is a need for an arrangement to minimize the number of antennas broken in car washes.

SUMMARY OF THE INVENTION

It is a feature of the present invention to provide a new and improved arrangement for retracting radio antennas of automotive vehicles just before, and during, washing of the vehicles in automatic car washes.

In view of this object and other objects, the present invention is directed to a system for automatically retracting telescoped antennas in automobiles equipped with automatic or standard transmissions upon shifting the transmission to neutral. Retraction is, however, delayed for a selected time period in the range of about 3–12 seconds in order to accommodate situations when the shift lever passes through neutral when being shifted from "drive" to "reverse" or "reverse" to "drive". Upon expiration of the time interval, a signal commands the retract function of a normal power antenna and energizes a motor or release which lowers the antenna.

In accordance with a more specific aspect of the invention, an "over ride" is provided to prevent retraction of the antenna when the car is shifted to neutral should the operator desire to keep the antenna extended while the automobile is in neutral. When the antenna is shifted from neutral to drive, the antenna again extends immediately if the radio is on.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
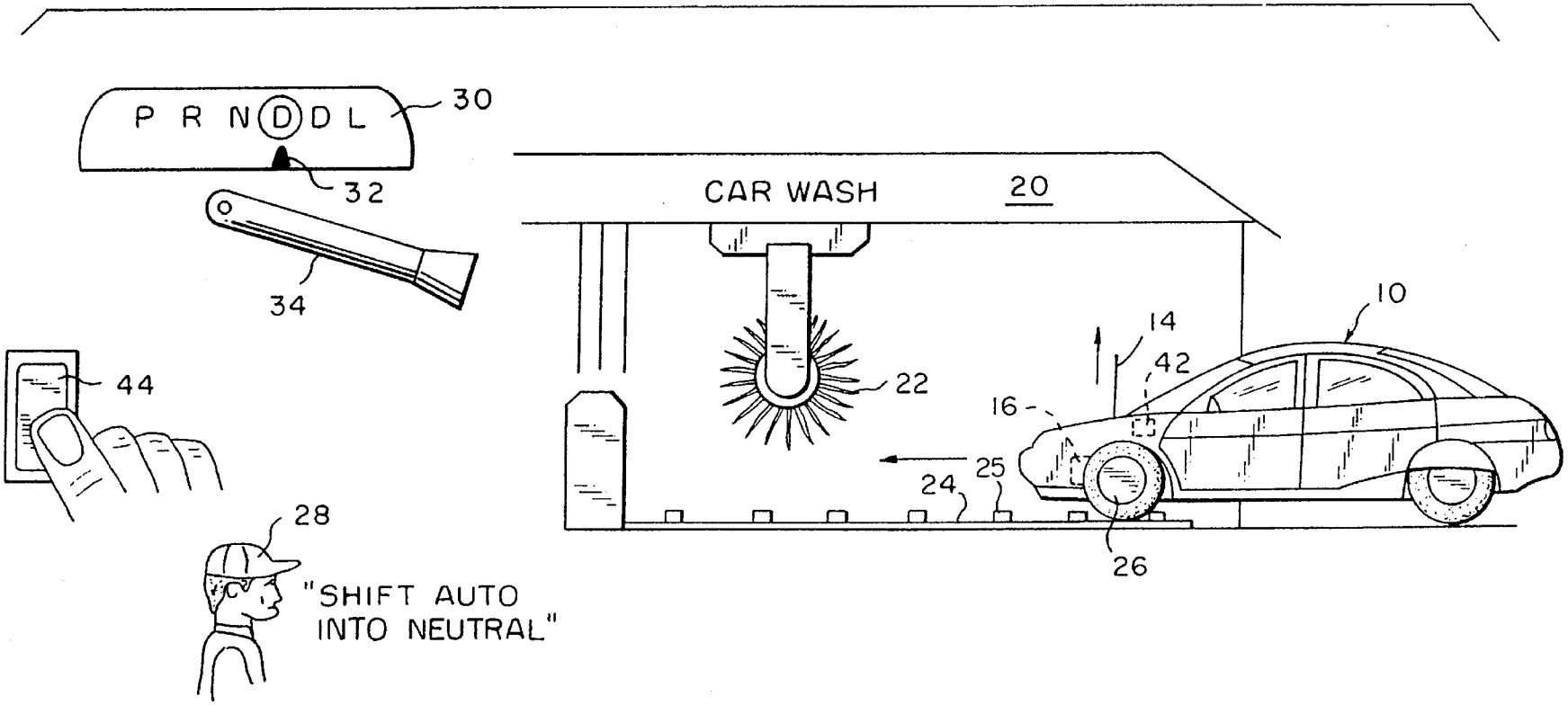
FIG. 1 is a composite diagram illustrating an initial condition to which the system of the present invention responds.

Referring now to FIG. 1, there is shown an automotive vehicle configured as a passenger automobile 10 which has a radio therein to which an antenna 14 is connected. The automobile 10 has an automatic transmission 16. While an automatic transmission 16 is preferable for use in conjunction with this system, the system may also function with a standard transmission. As is seen in FIG. 1, the antenna 14 is telescoped to an extended position for receiving radio signals. The automobile 10 is shown entering a car wash 20 which includes a rotary brush 22. In accordance with at least one extensively used car wash configuration, a continuous belt 24 with cogs 25 thereon engages the front wheels 26 of the automobile and drags the automobile through the car wash 20 while the brushes 22 clean the automobile. For a number of reasons, it is preferable to keep the engine of the automobile running while the automobile is being washed so, in order for the automobile 10 to be properly pulled through the car wash 20, the automatic transmission 16 of the automobile must be in neutral. Either an attendant 28 or a broadcast tape instructs the driver of the automobile 10 to shift into neutral before the cogs 25 begin pulling the automobile through the car wash.

Figure 2:
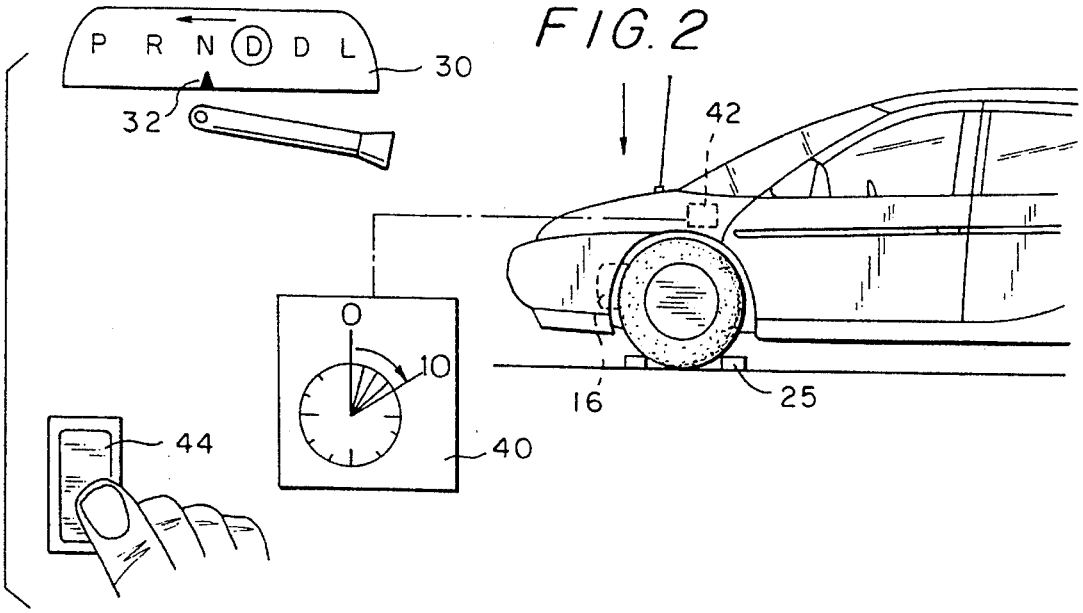
FIG. 2 is a composite diagram illustrating initiation of the operation of the system in accordance with the present invention.

In order to properly clean the automobile 10, the brushes 22 whip against the automobile's surface and in so doing may strike and snag the antenna 14. When this happens, the antenna bends and cannot thereafter be telescoped to the retracted position. If one attempts to straighten the antenna 14, then it frequently becomes crimped. A crimped antenna section frequently has a diameter greater than the section into which it is to be telescoped and thus cannot be retracted by being telescoped. Numerous antennas are damaged in this fashion every year, resulting in replacement costs which cost both consumers and manufacturers a considerable amount of money. The present invention ameliorates this situation by automatically retracting the antenna 14 when the automatic transmission 16 is shifted from drive to neutral, The state of the transmission is indicated by a transmission display 30 having the transmission state indicators park "P", reverse "R", neutral "N", drive "D", drive "D" and low "L". Alignable with each of these letters is a pointer 32 which is moved by the shift lever 34 as the transmission 16 is shifted between various modes. When an attendant (or tape) 28 announces the instruction "shift auto into neutral" (FIG. 1 ), the driver moves the lever 34 to shift the pointer 32 from the drive position "D" to neutral "N" (see FIG. 2). In accordance with the principles of the present invention, an elapsed time timer 40, located in the body computer 42 of the automobile 10, counts a 3–12 second interval. At the expiration of this time interval, the antenna 14 retracts. The timer 40 is then reset to "0" (see FIG. 3), when the shift lever is moved out of the neutral position.

Figure 3:
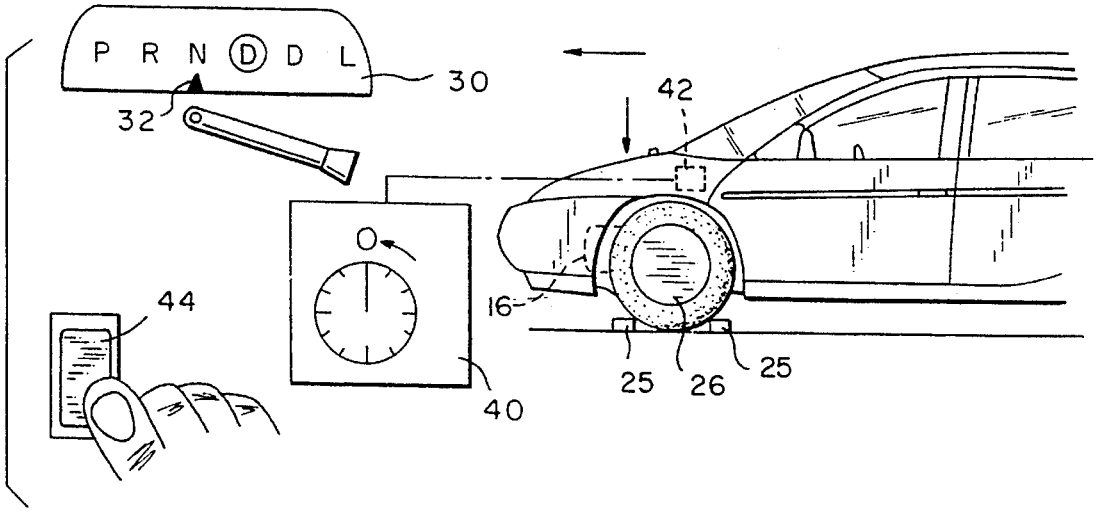
FIG. 3 is a composite diagram illustrating the condition resulting from operation of the system of the present invention.

Referring now to FIG. 3, it is seen that the transmission display 30 has the pointer 32 in the neutral position and the antenna 14 is retracted while the automobile 10 is being washed. The brushes 22 cannot snag or bend the antenna 14 because the antenna is retracted within the body of the automobile 10.

It is necessary to provide time delay because, as the transmission 16 is being shifted from park "P" to drive "D" or reverse "R" to drive "D" or vice-versa, the shift lever 34 passes through the neutral position "N". Momentary antenna retraction and extension would otherwise occur. In addition, from time to time, it may be desirable to briefly shift the transmission into neutral "N" for various reasons. It is only when the driver wishes to remain in neutral for an extended period of time, e.g., more than a predetermined time delay, that the body computer 42 causes antenna 14 to retract. The primary situation in which this is usual when the automobile engine is running is when the automobile 10 is in a car wash, such as the car wash 20.

If, for some reason, it is desired to place the transmission 16 in neutral with the engine running for more than a predetermined time delay and the driver wishes to maintain radio signal strength, an over-ride button 44 on the instrument panel is pressed. The over-ride button 44 interrupts the signal from the body computer 42 which would normally retract the antenna 14.

Referring now to FIG. 3, it is seen that, while the automobile 10 is in the car wash 20, the antenna 14 remains in the down position with the transmission 16 in neutral as is indicated by the arrow 32 in alignment with "N" on the display 30. The timer 40 within the vehicle body computer 42 has been timed out.

Figure 4:
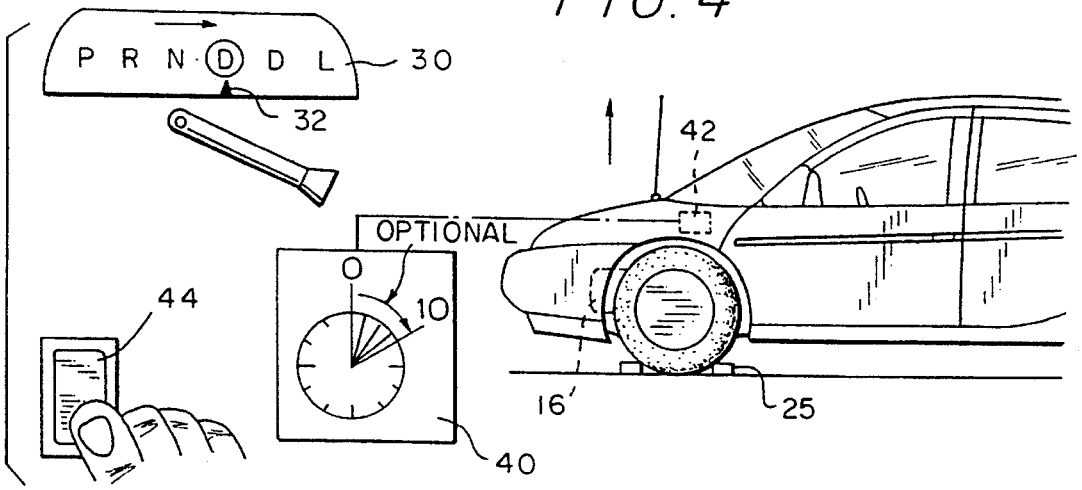
FIG. 4 is a composite diagram illustrating operation of the system in accordance with the present invention to return the automobile to the condition of FIG. 1.

Referring now to FIG. 4, when the car wash 20 has completed washing the automobile, the driver normally drives out of the car wash by shifting the shift lever 34 from the neutral "N" to the drive "D" position, the timer is reset to "0" and the body computer 42 emits a signal energizing a motor or release which immediately extends the antenna 14. The automotive radio then receives a full strength signal. The antenna 14 then remains extended until instructed to retract by turning off the vehicle's radio or engine or another time delay cycle is initiated.

Figure 5:
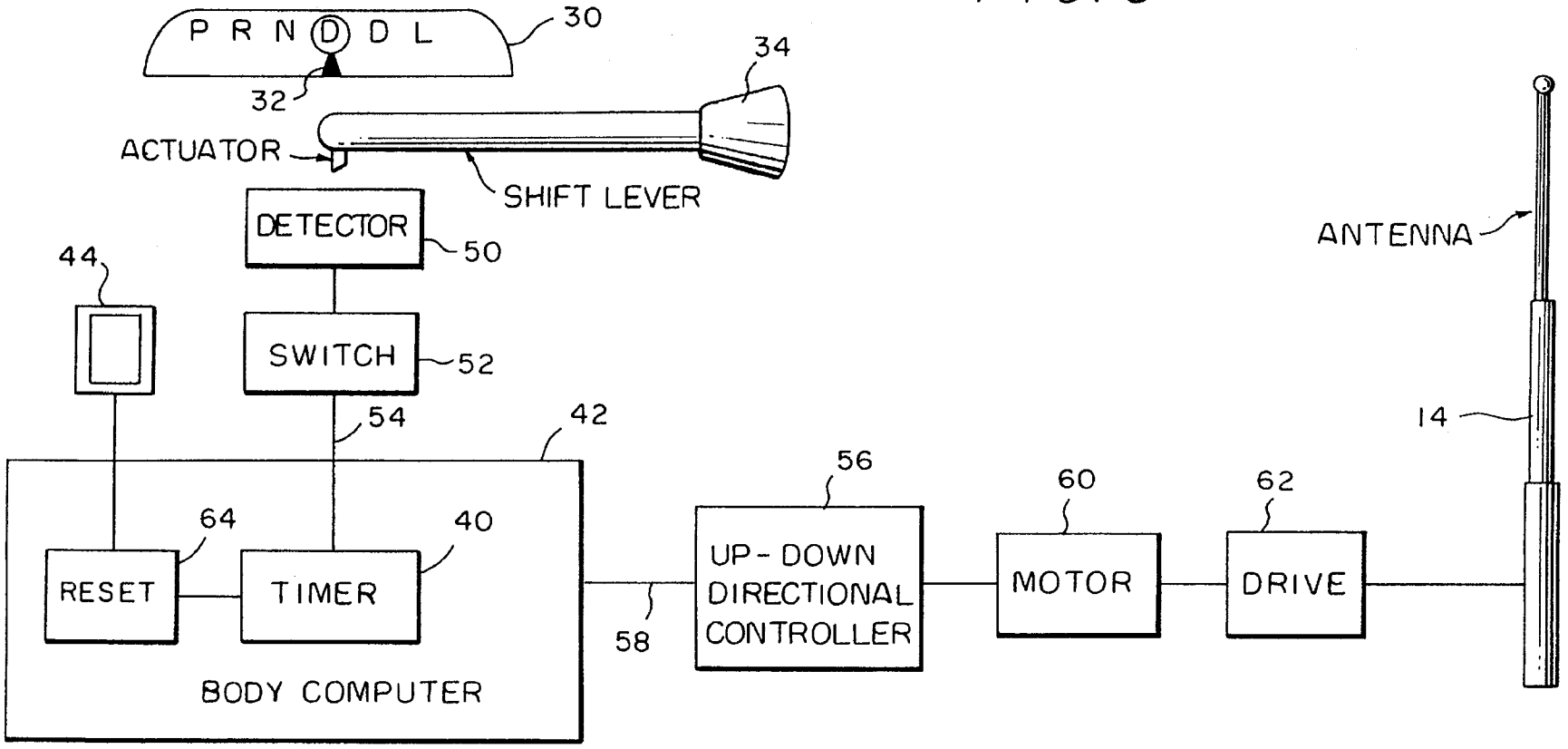
FIG. 5 is a block diagram schematically illustrating a first embodiment of the system of the present invention.

Referring now to FIG. 5, there is shown a block diagram illustrating operation of the system configured in accordance with the present invention wherein the transmission control lever 34 mounted proximate the display 30 moves the pointer 32 into alignment with the selected indicia "P", "R", "N", "D", "D" and "L" as the automotive transmission 16 (FIGS. 1–4) is shifted. Aligned with the neutral position "N" is a detector 50 which senses mechanically, magnetically or perhaps optically, movement of the lever 34 to the neutral position N. In a conventional fashion, the detector 50 causes a neutral position sensing switch 52 to close which pulses a line 54 which is connected to the timer 40 in the body computer 42. Upon expiration of the predetermined time period, which is in the range about 3 to 15 seconds and preferably about 10 seconds, the body computer 42 instructs a controller 56 via line 58 to cause a motor 60 retract the telescoping antenna 14.

An alternate arrangement is for the body computer 42 to have a sensor therein which detects shifting of the transmission to the neutral mode and upon detecting this shift to start the timer 40.

Retraction of the antenna 14 is accomplished in a conventional fashion by instructing a motor 60 to rotate in a first direction to retract the antenna 14 and in a second direction to project the antenna. The conventional approach may include a relay (not shown) associated with the motor 60 which when released causes the motor to rotate in the first direction to retract the antenna 14.

If it is desired to over-ride retraction of the antenna 14, the over-ride button 44 is pushed which interrupts transmission of the retract signal to line 58 by disabling the timer 40 within the body computer 42. If the shift lever 34 is moved from the neutral position to any other position during the predetermined time interval, the line 54 is pulsed to reset the clock 40 by opening the switch 52, thus interrupting the signal on line 58 to the controller 56 for retracting the antenna 14. Accordingly, if the timer is reset by either moving the shift lever 34 from the neutral position or disabled by operating the over-ride button 44 prior to the expiration of the 10 second interval, the antenna 14 will not retract. If the predetermined time has elapsed and the antenna is partially or fully retracted, the antenna will immediately extend.

After the car wash is completed, the shift lever 34 is shifted from the neutral "N" position to the "D" position. The timer 40 is then reset and the controller 56 will cause the motor 60 to immediately raise the antenna 14. If the antenna 14 is already raised, then the signal to the controller 56 has no effect since, according to conventional practice, a signal to extend the antenna has no effect.

Figure 6:
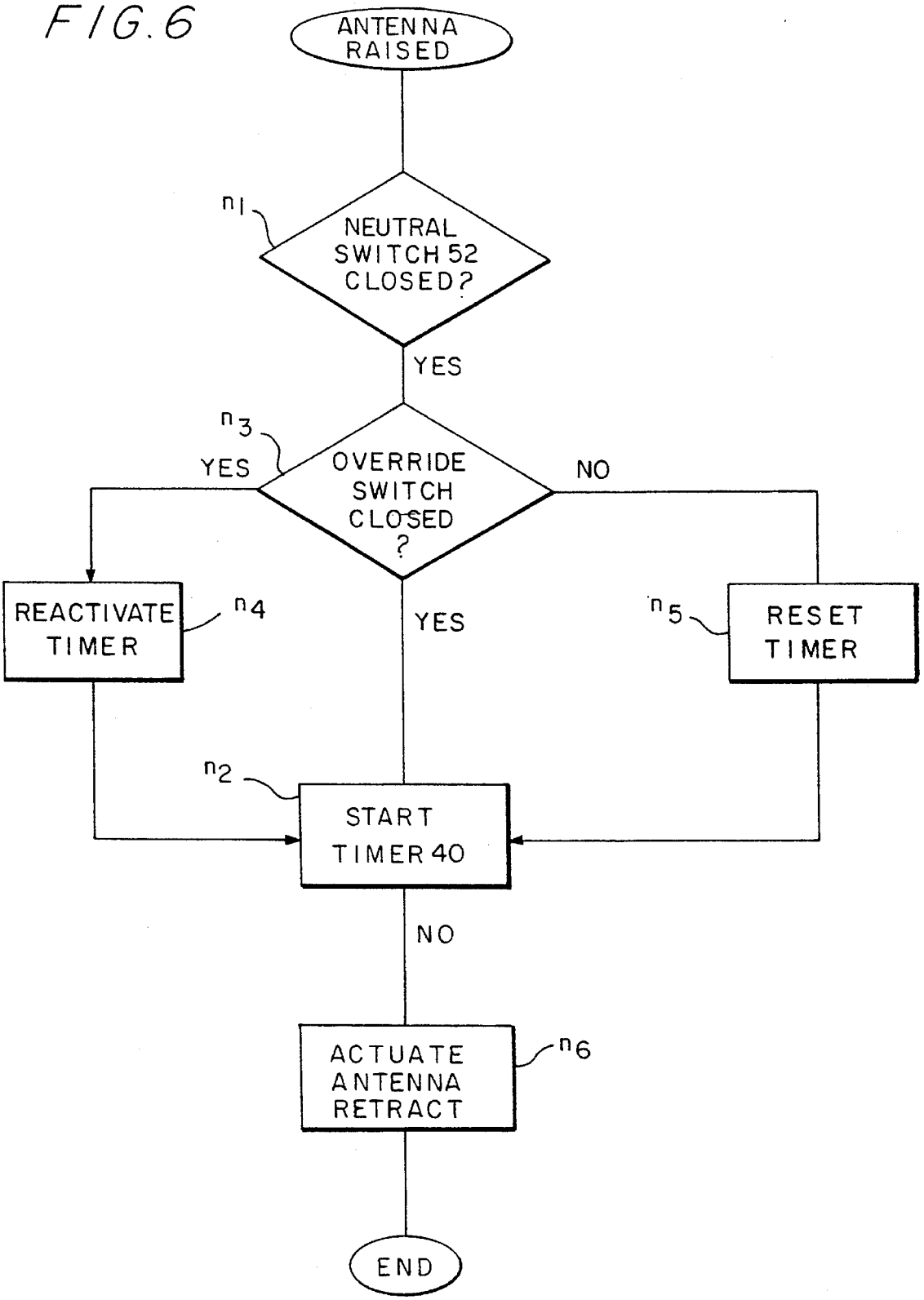
FIG. 6 is a flow chart illustrating the steps taken by a body computer in a vehicle to retract an antenna when the transmission of the vehicle is shifted from drive to neutral.

Referring now to FIG. 6, a flow chart sets forth the functions performed by the body computer 42. In step $n_1$, the switch 52 is closed to start the timer 40, step $n_2$. If the over-ride button 44 has been pushed in step $n_3$, the timer 40 is disabled in step $n_4$. In step $n_5$, it is determined if the transmission 16 has been shifted from neutral and, if it has, the timer 40 is reset. If the transmission has not been shifted to neutral, then in step $n_6$, a signal is supplied by the computer 42 to actuate the motor 58 to retract antenna 14. If the antenna 14 has already been retracted because the radio is off, then, according to conventional practice, a redundant signal to retract does not effect the antenna 14 because, according to conventional practice a limit switch associated with the controller 56 is open.

Figure 7:
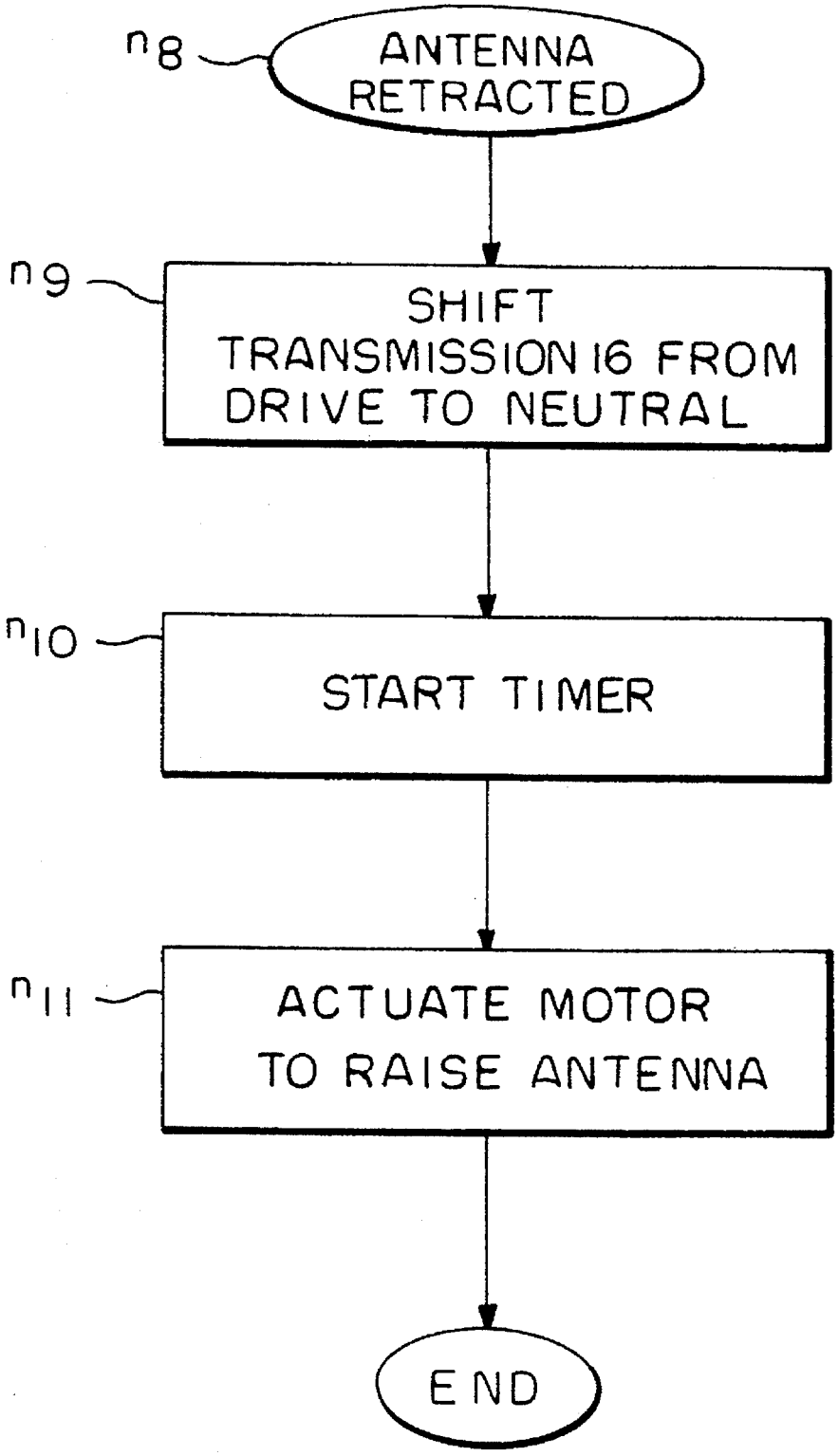
FIG. 7 is a flow chart illustrating the steps taken by the body computer when the transmission is shifted from neutral to drive.

In FIG. 7, the steps taken in the body computer 42 to lower the antenna 14 are as follows. In step $n_8$, the shift lever 34 is shifted from the "N" to the "D" position, causing the detector 50 to open the switch 52 which pulses the line 54 in step $n_9$. This causes the elapsed clock 40 to again count a 10 second interval in step $n_{10}$. The timer 40 then applies a signal to line 58 which causes the controller 56 to immediately drive the motor 60 to rotate in a direction to project the antenna 14. If the antenna 14 is already projected, then the controller 56 ignores the instruction to project the antenna since, according to conventional practice, a limit switch is open in the controller applying current to rotate the motor 60 in the direction to project the antenna.

Figure 8:
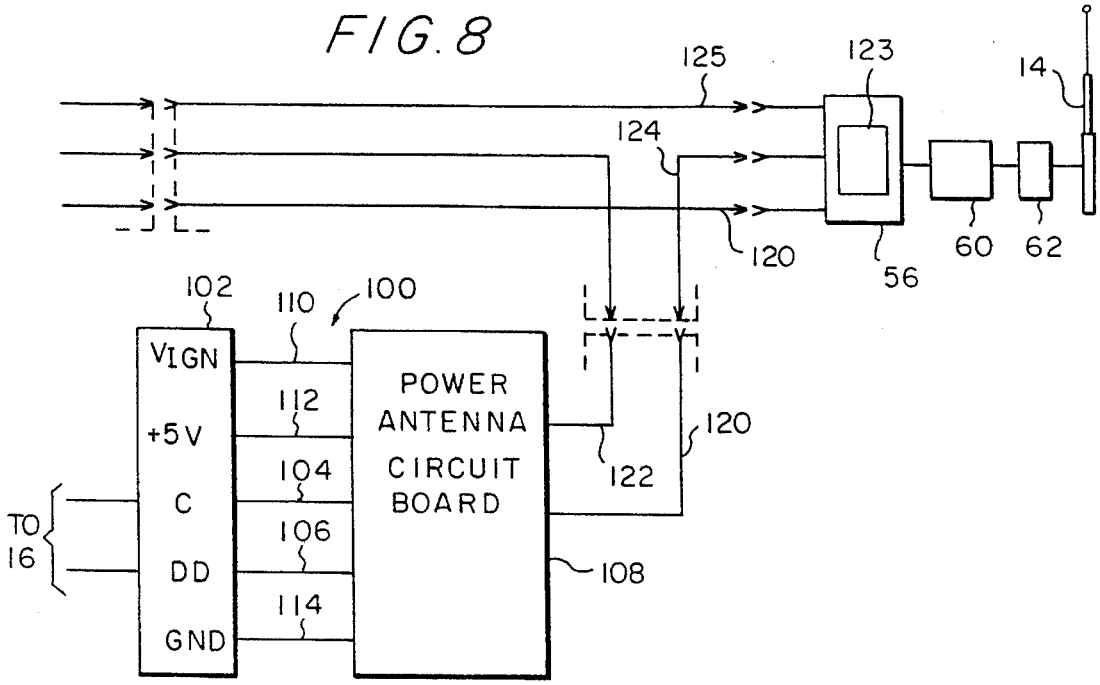
FIG. 8 is a circuit diagram showing a second embodiment of the system of the present invention.
Figure 9:
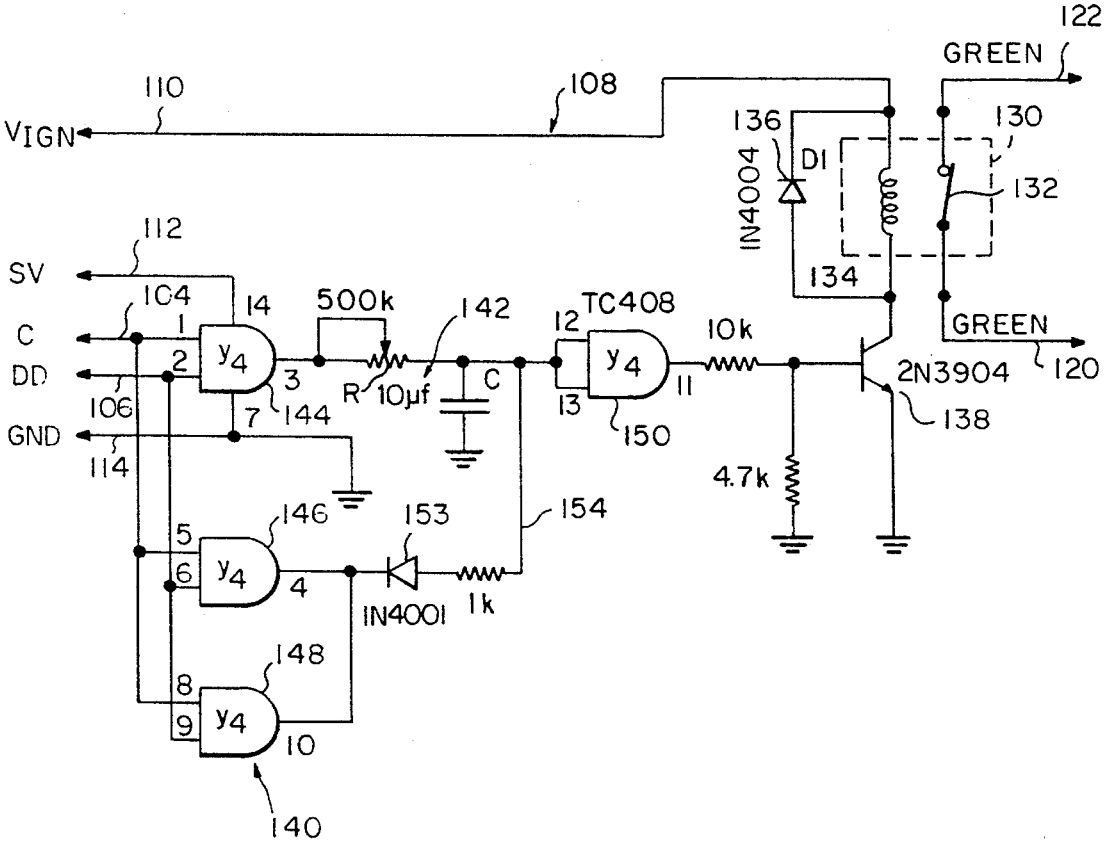
FIG. 9 is a circuit diagram illustrating the logic utilized in the embodiment of FIG. 8.

Referring now to FIGS. 8 and 9, there is shown an alternative embodiment of the invention wherein a system 100 causes a standard power antenna circuit 101 to automatically retract the antenna 14 when the transmission 16 is shifted to neutral (see FIGS. 1–5). In FIG. 8, a cluster connector 102 is connected to the transmission 16 to provide inputs on lines 104 and 106 from the transmission to an antenna retract control circuit 108. The cluster connector 102 also includes an ignition line 110, a 5 volt power line 112 and a ground line 114. As will be further explained hereinafter, the neutral position of the transmission 16 (when the shifter 34 is in the neutral position "N" of FIGS. 1–5) applies high inputs on lines 104 and 106. High inputs on lines 104 and 106 remove a 12 volt power feed from line 120 to the up-down directional controller 56. The power feed on line 120 keeps a relay 123 in the directional controller 56 energized. Upon interrupting current to the relay 123, the relay reverses the direction of current applied to the motor 60 causing the motor to retract the antenna 14.

Also connected to the directional controller 56 is a ground line 124 and ignitional line 125 which cooperate in a conventional fashion with the feed line 120 to power the motor 60.

The antenna retract control circuit 108 is shown in detail in FIG. 9 where it is seen that 12 volt power line 122 is connect to line 120 via an intermediate relay 130. The intermediate relay 130 includes a switch 132 which when opened removes 12 volt power from line 120 thus allowing the antenna 14 to retract. The intermediate relay 130 includes a coil 134 which is connected in parallel with a diode 136 through a transistor 138. When the transistor 138 is turned "on" the relay 130 opens, interrupting power to the relay 123 in the controller 56 and causing the motor 60 to retract the antenna 14.

The transistor 138 is connected to an AND gate circuit 140 through an RC timing circuit 142. The AND gate circuit 140 is connected to the lines 104 and 106 which are connected to the transmission 16. The AND gate circuit 140 compares two electronic PRNDL bits in AND gates 144, 146 and 148. When both bits are high, the AND gate 144 starts RC timing circuit 142 which initiates a 5-second delay (the time it takes capacitor C to charge). Depending on the ratings of the capacitor and resistor, the delay may be in the range of 3 to 12 seconds with about 5 seconds being preferred. Upon expiration of the 5-second delay a signal is applied to the base of transistor 138 through an AND gate 150 which turns the transistor 138 "on" and opens intermediate relay 130 releasing the antenna 14 by opening relay 123.

A reverse bias diode 153 is disposed in line 154 connecting AND gates 146 and 148 to AND gate 150 to block highs on lines 104 and 106 from turning on transistor 138. Whenever the bits on lines 104 and 106 are other than both high the transistor 138 will be "off." Accordingly, when the driver shifts into reverse or drive from neutral, the RC timer 142 is immediately discharged through AND gates 146 and AND gate 148, preventing the antenna 14 from retracting.

When the transmission 16 (FIGS. 1–4) is shifted from neutral into drive after being in neutral in a car wash, the AND gate 144 applies a low to a line 154 which is applied through to the transistor 138 which turns the transistor off and allows the intermediate relay 130 to close, applying power to reraise antenna 14. AND gates 146 and 148 continue to apply a low output on line 154 when either a low and high are applied to lines 104 and 106 or when both lines 104 and 1–6 are low. Consequently, the change in state of lines 104 and 106 cannot cause AND gates 146 or 148 to initiate retraction of the antenna 14.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A system for automatically retracting a telescopic radio antenna of an automotive vehicle, wherein the automotive vehicle includes a transmission, a shift lever for shifting the transmission between neutral and reverse and drive modes, a system for extending and retracting the telescopic radio antenna and a body computer for controlling all computerized systems of the vehicle, including commands to raise and lower the radio antenna by virtue of the radio being connected through the body computer to an antenna motor, the system comprising:

a detector for sensing when the transmission is shifted from the drive mode to the neutral mode by moving the shift lever from a drive to a neutral position;

an electrical connection between the detector and body computer for transmitting a signal from the detector to the body computer indicating a shift of the transmission from the drive to the neutral mode;

a timer within the body computer for counting a selected time interval, the timer being connected to the detector by the electrical connection; and a controller for driving the antenna motor to extend the antenna when in a first mode and for retracting the antenna when in a second mode, the controller being connected to the timer within the body computer and causing the motor to retract the antenna upon expiration of the selected time interval.

2. The system of claim 1, further including an over-ride button within the vehicle, the over-ride button being connected to a timer disable circuit in the body computer for disabling the timer upon pressing the over-ride button so that the antenna does not retract.

3. The system of claim 2, wherein the detector resets the timer upon the transmission being shifted from the neutral mode to the drive mode and wherein this immediately initiates operation of the motor to raise the antenna.

4. The system of claim 1, wherein the detector restarts the timer upon the transmission being shifted from the neutral mode to the drive mode and wherein the timer immediately initiates operation of the motor to raise the antenna upon expiration of the selected time interval.

5. A method of controlling a radio antenna of an automotive vehicle, wherein the automotive vehicle is equipped with a transmission, a body computer and a sensor connected to the transmission for notifying the body computer that the transmission has been shifted into neutral or into drive, the method comprising the steps of:

when the transmission is in drive, shifting the automatic transmission to neutral;

detecting the shift of the transmission from drive to neutral;

starting a clock to count a time interval upon the shift from drive to neutral being detected, after elapse of the time interval activating an antenna motor to retract the antenna.

6. The method of claim 5 further including the step of selectively over-riding the activating of the antenna motor to retract the antenna.

7. The method of claim 6 further including the steps of:

restarting the clock upon shifting the transmission from neutral to drive, and extending the antenna upon shifting out of neutral.

8. An improvement in a system for automatically retracting a radio antenna of an automotive vehicle wherein the automotive vehicle includes a transmission with a sensor associated therewith wherein the sensor emits a selected signal when the transmission is in neutral and wherein the system includes a motor for extending the antenna when rotated in a first direction and for lowering the antenna when rotated in a second direction, the motor being controlled by a direction reversing controller including a relay which when energized causes the motor to extend the antenna and when deenergized causes the motor to retract the antenna, the improvement comprising:

a detector for detecting when the transmission of the vehicle is shifted from drive to neutral;

a timer activated by the detector to time a selected time interval;

a circuit connected to the timer and to the relay for deenergizing the relay upon expiration of the time interval to cause the antenna to retract, the circuit including an arrangement for interrupting retraction of the antenna if the transmission is shifted from neutral before expiration of the interval.

9. The improvement of claim 8 wherein the detector has a digital output and the timer is an RC circuit connected to the detector by an AND gate circuit and connected to the relay in the direction reversing controller by a transistor and an intermediate relay, wherein when the intermediate relay is opened, current to the relay in the direction reversing controller is interrupted causing the motor to retract the antenna.

* * * * *